United States Patent [19]

Buck

[11] 3,950,813

[45] Apr. 20, 1976

[54] SQUEEGEE

[76] Inventor: S. Keith Buck, 7711 Rosemead Blvd. No. 68, Pico Rivera, Calif. 90660

[22] Filed: Oct. 9, 1974

[21] Appl. No.: 513,246

Related U.S. Application Data

[63] Continuation-in-part of Ser. No. 371,373, June 19, 1973, abandoned.

[52] U.S. Cl. ..... 15/245; 15/250.36; 24/206 R; 403/329

[51] Int. Cl.[2] ..... A47L 1/06

[58] Field of Search ..... 15/245, 250.4, 172, 15/177, 176, 194, 202; 403/329, 328, 388; 24/206 R, 230 CP

[56] References Cited

UNITED STATES PATENTS

| | | | |
|---|---|---|---|
| 635,462 | 10/1899 | Bourke | 15/245 |
| 734,370 | 7/1903 | Rofe | 15/245 |
| 948,630 | 2/1910 | Lane | 15/245 |
| 2,128,454 | 8/1938 | Cullin | 15/250.36 |
| 2,197,927 | 4/1940 | Ehrlich | 15/245 |
| 2,229,084 | 1/1941 | Horne | 403/329 X |
| 2,261,475 | 11/1941 | Kautenberg | 15/245 |
| 3,385,299 | 5/1968 | Le Roy | 24/206 R |

FOREIGN PATENTS OR APPLICATIONS

| | | | |
|---|---|---|---|
| 40,818 | 6/1916 | Sweden | 15/245 |

*Primary Examiner*—Peter Feldman
*Attorney, Agent, or Firm*—Christie, Parker & Hale

[57] ABSTRACT

A professional squeegee comprising a handle, wiping blade holder and a resilient wiping blade of rectangular cross section. The blade is retained by the blade holder in a floating restraint by means of a longitudinal groove in the blade or the upper leg of the holder and a corresponding longitudinal bead or other protrusion in the other element for mating engagement with the groove. Removable pins engage the holder and detents at the end of the wiping blade to support the wiping edge at the extremities. Holding the blade in this manner allows it to float and assume its true wiping edge without distortion or influence from external clamping.

24 Claims, 16 Drawing Figures

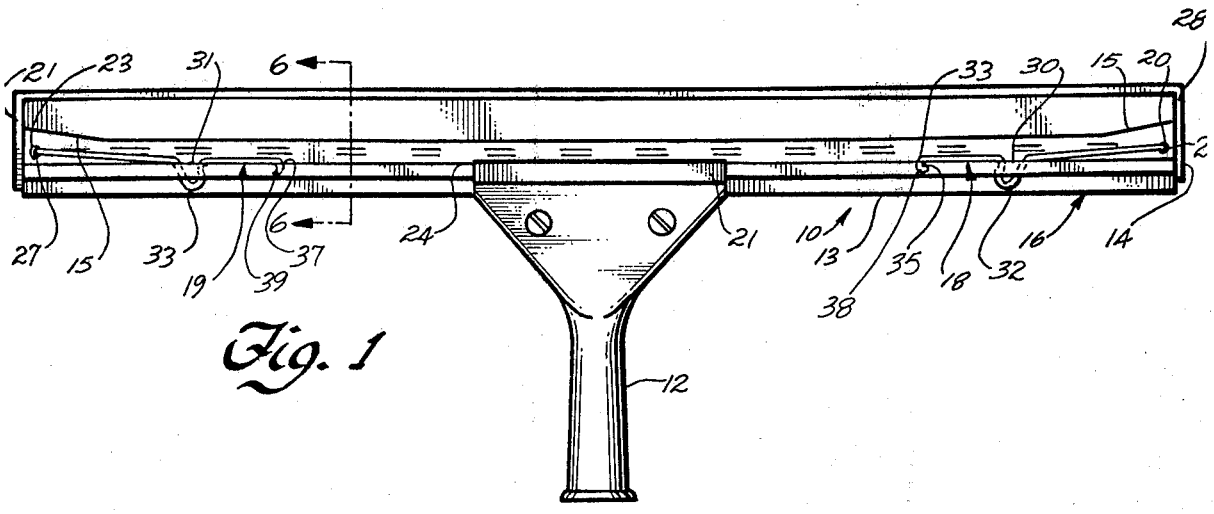
Fig. 1
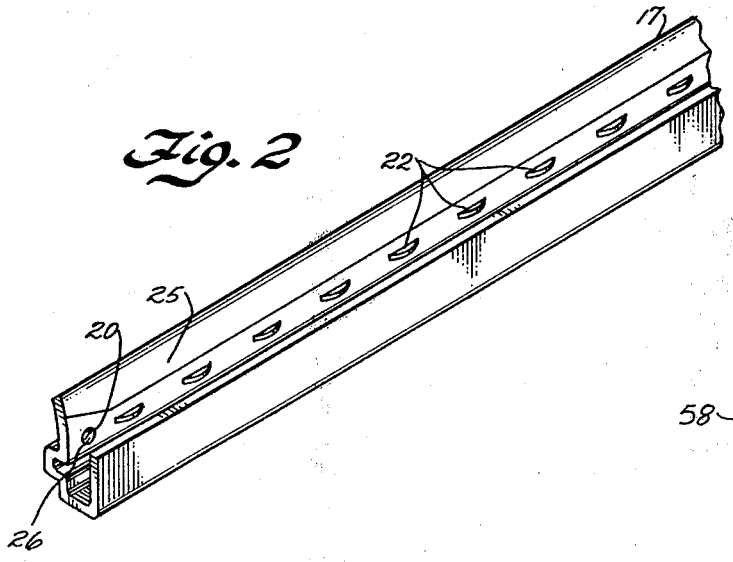
Fig. 2
Fig. 10
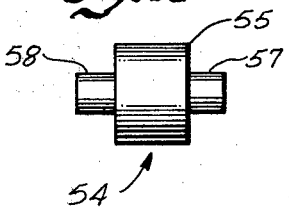
Fig. 3
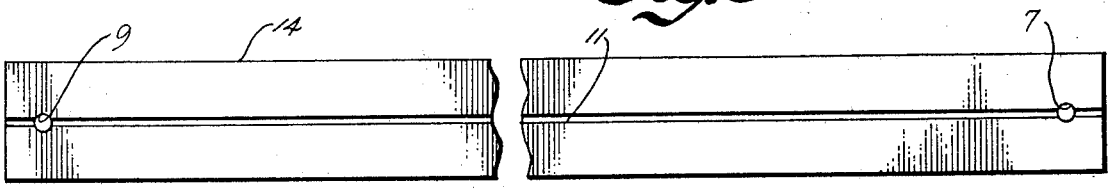

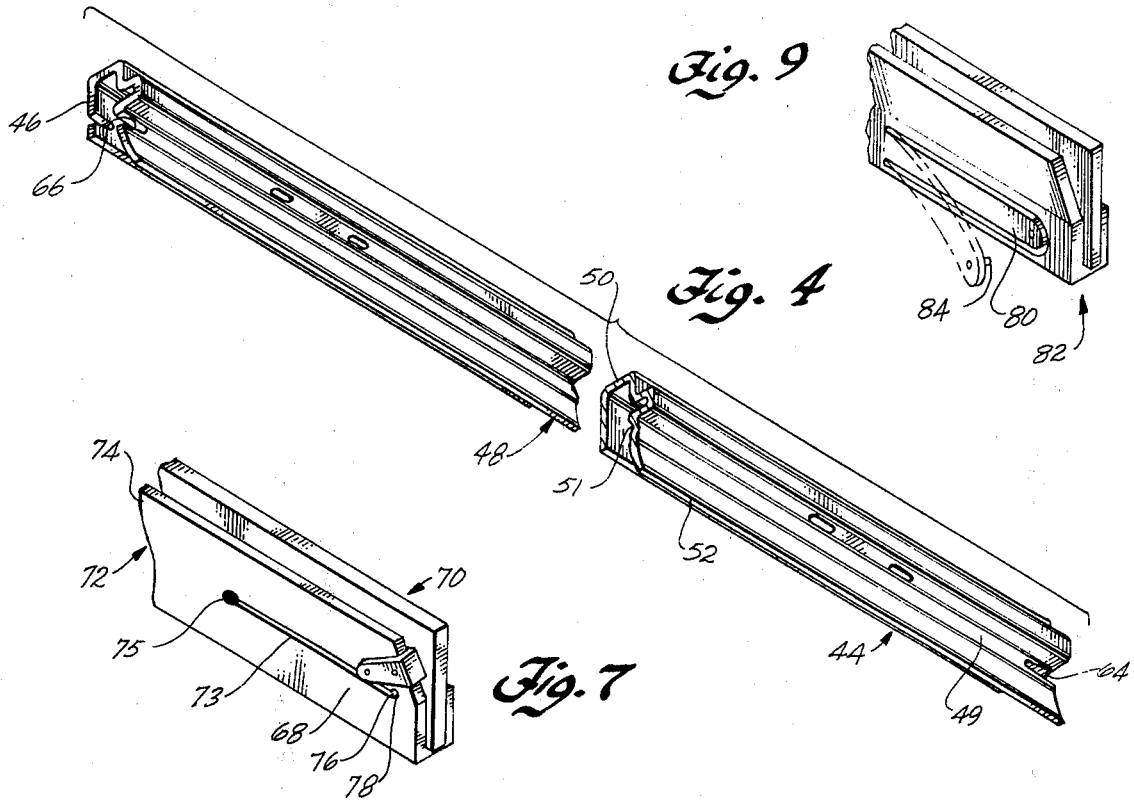
Fig. 8A
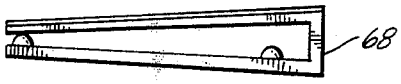
Fig. 6
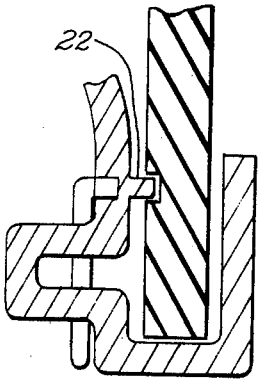
Fig. 8B
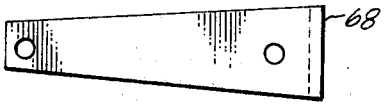
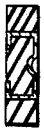
Fig. 5C
Fig. 5A
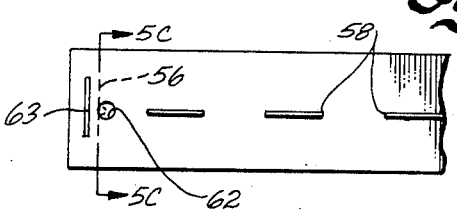
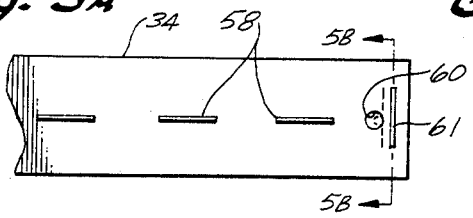
Fig. 5B
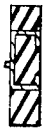

SQUEEGEE

REFERENCE TO RELATED APPLICATIONS

This is a continuation-in-part of application Ser. No. 371,373, filed June 19, 1973, now abandoned.

DESCRIPTION OF THE PRIOR ART

The present invention relates to implements for wiping surfaces and in particular to squeegees for use on windows, floors, walls and the like.

In U.S. Pat. No. 2,123,638, a well-known squeegee tool is described. This type of squeegee is characterized by a handle, a holder for a wiping blade, and an elongated rubber wiping blade with a bead formed along one longitudinal edge. The wiping blade is retained in the holder by means of a circular channel formed into the back or spine of the holder which receives the beaded edge of the blade. The blade is restrained against longitudinal movement in the holder by means of clips which grip the wiping blade at each end thereof. Wings are formed in the clips and are oriented at right angles to the plane of the blade when the clips are placed on the blade. When the blade is mounted in the holder the wings of the clips at each end abut and bear against the outside edges of the holder.

This type of squeegee while useful is subject to the disadvantage that the wiping blades are difficult to change requiring that the blade be extended and tensioned so as to cause the clip at one end to clear the holder permitting its removal. Once one clip has been removed the blade is then slid out of the holder from the other end. The reverse, the insertion of a new blade is even move cumbersome, tedious, and time-consuming. The two hands of the user must handle three separate articles at the same time: the holder, the blade and the tiny clip. To assemble the squeegee, the clip must be inserted over the bead of the blade, forced against it so that teeth on the inside surface thereof bite into the blade and then carefully pressed into holder while still maintaining its position on the blade. With one of the clips this must be done while maintaining longitudinal tension on the blade. These difficulties constitute a significant deterrent to the changing of the wiper blade and particularly at such times when the blade begins to develop an impairment of its wiping edge in the middle of a window washing operation.

Even if the retaining clips could be attached accurately two problems remain:

a. the teeth of the clip biting into the blade displace and compress this area of the blade and distortion results, b. the material thickness of the clip between the blade and holder forces the wiping edge of the blade to protrude further from the holder at the ends than in the middle; thereby preventing the blade from assuming a desired straight and true wiping edge.

In addition, due to the fact that the wiping blade requires a bead formed along one edge, the blade of the prior art squeegee has only two edges available for use as wiping edges, the second being obtained by turning the blade over when the first of the two edges wears out.

An alternate method of securing the blade in its holder is by the use of a clip member secured to the squeegee handle which has a plurality of teeth on it which bite into the blade at its center opposite the squeegee handle such as shown in U.S. Pat. No. 2,905,959. This is also disadvantageous since, when the ends of the wiping blade touch or strike the frame of a window it compresses longitudinally back into the channel, causing skipping due to the blade or rigid surface of the holder chattering against the edge of the window frame and disrupting the smooth continuous stroke necessary to prevent smearing of the cleaned surface.

In attaching a handle and clip member combination which grips the blade with teeth biting into it as in the above U.S. Pat. No. 2,905,959 the blade is not only expanded, due to the displacement of material, but is dislocated within the holder itself, i.e., the central portion is forced forward in the holder, again distorting and eliminating true straight edge of the wiping blade.

SUMMARY OF THE PRESENT INVENTION

The present invention provides an improved squeegee comprising a wiping blade holder of a generally U-shaped channel configuration having a wide upper leg and a narrower lower leg interconnected at one side thereof by a web portion. The legs are spaced apart to receive a flat wiping blade and the upper leg of the holder has longitudinally extending blade engaging means in the inside face thereof for slidably engaging mating holder engaging means on the blade to hold the wiping blade along a longitudinal axis to provide a wiping edge of the squeegee. The blade engaging means is dimensioned relative to the holder engaging means to provide a slight floating movement of the blade in the holder to precisely align the blade to a working position by direct face contact with the upper leg and contact with the web portion at the edge opposite the wiping edge. An elongated resilient flat blade defining at least one sharp wiping edge along the longitudinal extent thereof is provided. The blade has holder engaging means located on at least one wide face thereof for matingly engaging the blade engaging means of the holder located along the longitudinal extent of the blade. Handle means for the squeegee are attached to the holder.

In another aspect the invention provides an improved squeegee wiping blade comprising a length of resilient material rectangular in cross section along its transverse and longitudinal axis, the blade being formed by being cut from a relatively thin flat sheet of resilient material to provide a blade having two narrow elongated faces, two narrow end faces and two wide transverse faces. The transverse dimension of the blade is large relative to the thickness dimension of the blade. The junction of the elongated faces and the transverse faces provides four sharp wiping edges. An aperture extends through the blade perpendicular to its transverse faces adjacent each end of the blade, the aperture being dimensioned and located to register with blade retaining means. Holder engaging means are also provided along the longitudinal extent thereof to engage mating blade engaging means on the holder in a slight floating relationship to precisely align the blade to a working position, the aperture and holder engaging means being located along the centerline of the two transverse faces whereby the blade is completely reversible.

In contrast to the prior art the squeegee of the present invention in its preferred embodiment provides a blade which has four wiping edges and one which is easily and quickly changed or reversed to provide one of the remaining edges as the working edge. Retaining means in the form of step pins and retractable pins which engage the adjacent blade to restrain it against lateral movement at the end are easily removed and replaced. The change of blade or reversing of edges is accomplished simply by retracting the pins, sliding the blade out of the holder longitudinally, reorienting it to provide a new edge or replacing it with a new blade and longitudinally reinserting it.

By eliminating the bead formed along one of the long edges, the blade of the present invention is now not only capable of providing four wiping edges but is more easily fabricated, eliminating the need for extrusion of the blade in predetermined widths with a bead formed along one edge. This simplified approach allows the blade to be cut from flat calendered sheets of a rubber suitable for the wiping application. By retaining the blade in position in a holder with longitudinal blade engaging means such as a longitudinal protrusion on the inner face of the upper leg and a mating longitudinal groove in the transverse face of the blade and blade retaining means at the ends, the blade has a slight amount of "float" or "play" in the holder in the transverse direction but is essentially fixed in the longitudinal direction eliminating external clamping of the blade and allowing the blade to present a true, straight, undistorted wiping edge.

In the presently preferred embodiment of the invention there is provided a wiping blade of a flat flexible material, having a continuous, longitudinal groove along its centerline and an aperture or detent in the wide faces of the blade at and quite near each end, and on its center line. The location of these elements on the center line enable the blade to be flipped over so the blade may be reversed, thereby incorporating four separate and independent wiping edges in each blade.

The apertures are accurately punched and precisely located so as to register with pins or detents located in the blade holder. Regardless of the specific embodiment, the holder and blade engaging means are characterized by one common operating principle, namely, they secure and restrict the movement of the blade without clamping it externally, thereby not distorting its true working edge.

Because of the pre-positioning of the aperture in the blade and the restraining means in the holder, a consistent close tolerance of the length of blade material extending beyond the holder may be attained. In the present invention only a very small extension of blade beyond the holder end is required, since the positive lock of the pin and aperture assures that the blade material will not be forced back into the holder as the end is pressed against the window frame and glides along it. This is of primary importance, for if the rigid edge of the holder touches the frame of the window, rather than the flexible edge of the blade, the smooth glide of the squeegee over the surface to be wiped is interrupted and smearing results.

Conversely, if too much blade material extends beyond the frame, the lack of support for the flexible blade allows it to compress or bend and cause a bouncing or skipping action as the squeegee is drawn along the frame, and again smearing results.

In the preferred embodiment a holder of a generally U-shaped channel configuration is utilized with a longitudinal series of projections raised from the inner face of the upper leg of the holder and retractable pins being provided as the blade retaining means. Dimensionally, the projections and pins are slightly smaller than a longitudinal groove and apertures or detents in the ends of the blade which they engage to allow a very slight movement of the blade within the channel. Due to the close dimensional tolerances of the blade that are easily maintained in the simplified design of the blade characteristic of the present invention, this amount of movement is enough to allow the back edge of the blade to float and seat against the web of the rigid channel. This assures a true working edge at the front edge of the wiping blade, since no external clamping means are required either to prevent the blade from falling out of the holder or to insure positive restraint against pressure applied to the ends of the blade as it bears against window frames and the like when in use.

DESCRIPTION OF THE DRAWINGS

These and other advantages of the invention will be better understood by reference to the figures of the drawing wherein FIG. 1 is a plan view of an improved squeegee according to the present invention;

FIG. 2 is a perspective view of a portion of the blade holder and blade retaining means of the squeegee of FIG. 1;

FIG. 3 is a plan view of a flexible wiping blade according to the present invention;

FIG. 4 is a perspective view of an alternate embodiment of the blade holder according to the present invention;

FIG. 5A is a plan view of an alternate embodiment of the flexible wiping blade;

FIG. 5B is a cross sectional view taken along lines 5B—5B of FIG. 5A;

FIG. 5C is a cross sectional view taken along lines 5C—5C of FIG. 5A;

FIG. 6 is a cross-sectional view taken along lines 6—6 of FIG. 1;

FIG. 7 is a perspective view of an alternate embodiment of the end of the squeegee of the present invention;

FIG. 8A is a front elevation view of holder clip for use with the embodiment of the squeegee of FIG. 7;

FIG. 8B is a plane view of the clip of FIG. 8A;

FIG. 9 is a perspective view of another alternate embodiment of the end of the squeegee of the present invention;

FIG. 10 is an elevation view of a step pin;

DESCRIPTION OF THE SPECIFIC EMBODIMENT

Figure 11:
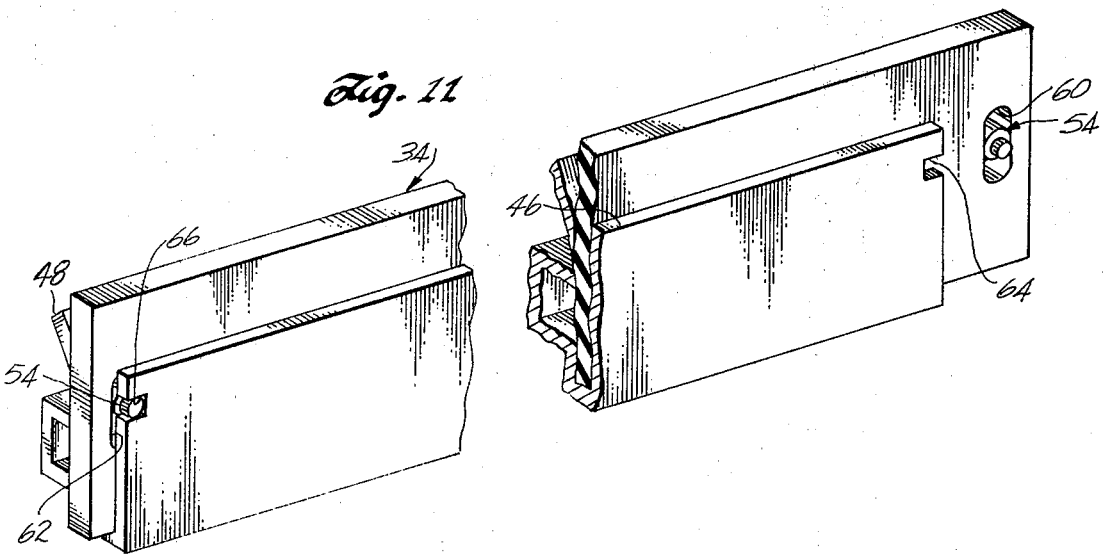
FIG. 11 is a perspective view of the holder and blade of FIG. 4 and FIGS. 5A, 5B and 5C respectively, illustrating the manner in which the step pins secure the blade in the holder under tension.

Referring now to FIGS. 1 and 6, as shown therein the invention comprises a squeegee 10 having a handle 12, a blade 14 of a flexible material, and a blade holder 16. As will be more clearly illustrated in the following figures of the drawing, the holder 16 is a channel generally U-shaped in cross section which receives and holds a flat straight-sided rubber blade for wiping excess moisture from windows, floors, and the like. Attached to leg 17 of holder 16 is a first spring wire 18 and a second spring wire 19 which extend longitudinally of the holder and are bent or crimped at their opposite ends to provide retractable pins 26 and 27, which extend through apertures 20 and 23, respectively, into the space within the U-shaped holder channel. Also formed into leg 17 of the holder channel is a ridge or shelf 24, again generally of a U-shaped channel cross-sectional configuration. Ridge 24 provides the means for mounting wire springs 18, 19, anad also provides a gripping or surface of purchase whereby handle 12 grips and securely mounts the holder and wiper blade assembly of the squeegee by means of a receiving detent 21.

In order for blade 14 to utilize its flexibility, a portion of leg 17 is curved or bent, the point of curvature starting at a point about half way up leg 17 from the web or spine 13 of the channel. As pressure is applied to handle 12, it is transmitted to and distributed evenly along the direct face to face contact between the deflecting blade and the curved portion of leg 17. This pressure in turn is transmitted outwardly (from every point along the surface of contact) to the working edge of the blade.

Except at each end of the blade, points all along the working edge of the blade are connected to and supported by adjacent material from both sides. At the ends support comes from only one side. The result is that the amount of pressure applied to the working edge at the very end thereof is about half that which is provided at points located interiorly of the blade ends.

To provide a uniform amount of pressure all along the length of the blade to the very end, the straight portion of leg 17 is extended further from the channel web 13 in the area adjacent the ends of the holder. The boundary of this increased straight or flat holder area is defined by line 15. This extended support by the holder at the ends, compensates for the reduced pressure at the ends. The curved or bent portion of leg 17 therefore starts at a distance farther removed from the web 13 near the ends of the holder but ends with the same degree of curvature at its outer edge so that this outer edge of leg 17 remains a straight line along its entire length. This is necessary so that at such times as pressure is applied sufficient to deflect the blade back around the curvature, to the edge of the leg 17, equal pressure is transmitted to the wiping edge even in its position of greatest deflection.

Mating apertures (see FIG. 3) are provided in blade 14 and located in registration with apertures 20, 23 of the holder whereby the ends of pins 26, 27 of wire springs 18, 19 likewise pass through the blade apertures to hold and support the blade in the longitudinal direction, particularly the small portion 28, 29 thereof extending beyond each longitudinal end of the holder and thereby brace portions 28, 29 against compression back into the channel of the holder.

Also formed in leg 17 is a series of projections 22 along the longitudinal extent of its inside face 25, providing means for interlocking a small, longitudinal groove 11 (FIG. 3) in the blade 14. A continuous ridge (not shown) formed in the inside face 25 is also contemplated by the present invention as a substitute for projections 22 as blade engaging means for holding a squeegee blade in the holder. The series of projections 22 or ridge (if utilized) are dimensioned relative to groove 11 such that they are slightly smaller to provide a slight floating movement of the blade in the holder to precisely align the blade to a working position supported by face to face contact with face 25 of leg 17 and at the narrow elongated face of the blade opposite the wiping edge by web 13.

Apertures 30, 31, are cut in the sides of ridge 24 for receiving clip portions 32, 33 formed in wire spring 18, 19. Apertures 35, 37 are also cut in the sides of ridge 24 for receiving the crimped ends 38, 39 of wire springs 18, 19. Clip portions 32, 33 have a shape generally resembling the letter "C" whereby wire springs 18, 19 are secured in place on the holder. The engagement of clips 32, 33 and apertures 30, 31 is a snap fit. Spot welding and other means of securing one or more lengths spring wire to the holder are also contemplated by the invention. The ends of wire spring 18 and 19 are bent at a 90° angle relative to the longitudinal axis of the wire spring and likewise at a 90° angle with respect to the plane of the C-shaped clip portions 32, 33 to create the spring loaded, retractable pins which engage the mating apertures in the wiping blade.

A plan view of a wiping blade 14 for use with the present invention is shown in FIG. 3. As shown therein blade 14 is an elongated flat strip of a flexible material such as rubber having a longitudinal groove 11 and apertures 7, 9 located generally along the central longitudinal axis of the blade. Apertures 7, 9 are located close to the opposite ends of the blade. The groove anad apertures are engaged by the projections 22 and retractable pins 26, 27 on the holder respectively to retain the wiper blade 14 in the holder and provide the floating restraint characteristic of the invention. The pins also support the edges of blade which are dimensioned so as to extend only approximately 1/32 inch beyond each end of the holder. Such dimensioning and support prevents excessive compression of the blade ends and "bouncing" or "chattering" of the squeegee as it is drawn along a window frame. The result is a squeegee having a resilient guide at each end.

Insertion and removal of the wiping blade is accomplished by longitudinal sliding of the blade 14 relative to the holder 16. The groove 11 or other holder engaging means is mated or registered with the first of the projections 22 or other blade engaging means at one end of the holder to begin the insertion process. Pins 26, 27 are retracted at this point. The blade 14 is fed longitudinally into the holder, the projections acting as a guide as the blade is slipped into the channel. When properly positioned with apertures 7, 9 in the blade in registration with apertures 20, 23 in the holder, pins 26, 27 are inserted into the apaertures to complete the loading process. The improved squeegee of the present invention is then ready for use. Removal of the blade to provide a new wiping edge or an entirely new blade is the reverse of the foregoing process. Location of the groove 11 and apertures 7, 9 in the blade along the central longitudinal axis of the blade permit the blade to be completely reversible providing four sharp wiping edges.

An alternate embodiment of the holder and blade of the present invention is also contemplated and such alternate embodiment is illustrated in FIGS. 4 and 5. As shown in FIG. 4, holder 44 is essentially a straight generally U-shaped channel, comprising a first leg 46 and a second leg 48 joined by a web 50. Leg 48 is bent or curved adjacent its outer edge 52 to provide a supporting surface for the wiper blade as it is drawn across the surface to which the squeegee is applied.

In this embodiment a pin 54 is provided in the form of a step or wedging pin for engagement with apertures 60, 62 in blade 34 and a notch 64, 66 formed in the transverse ends of legs 44, 46 of the holder. To lock the blade in place a first pin 54 is fitted into one of the apertures 60, 62 and the assembly is placed in the holder with the extremities of the step pin in engagement with its corresponding notch 60 or 62. The opposite end of blade 34 is stressed to clear the remaining aperture of the blade beyond the end of the holder and the remaining step pin 54 is placed in the aperture in the blade. The blade is then allowed to retract drawing the extremities of the step pin into engagement in the notch at that end of the holder.

The alternate embodiments of FIGS. 4 and 5 also illustrate alternate embodiments of the blade engaging means on the holder and the holder engaging means on the blade.

As shown in FIG. 4 an outwardly protruding bead 49 is formed on leg 48 of the holder resulting in a groove 51 on the inner face of leg 48. In FIG. 5A a series of spaced apart staples 58 have been emplaced in blade 34 along the longitudinal axis of the blade such that they define a ridge located so as to register and engage the groove 51 in the inner face of leg 48. Insertion and removal of the blade is accomplished in the same manner as described with respect to the previous embodiment.

Figure 12A:
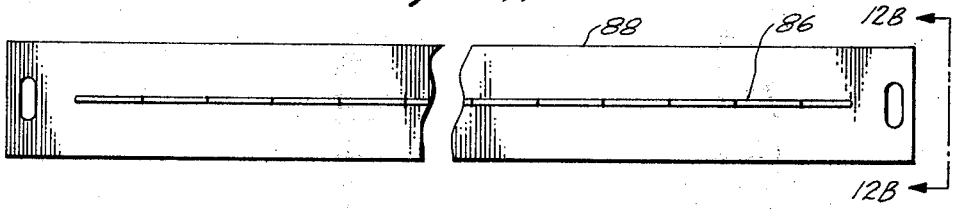
FIG. 12A is a plan view of an alternate embodiment of the flexible wiping blade.
Figure 12B:
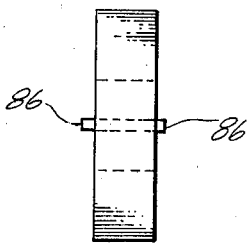
FIG. 12B is an end view of the blade of FIG. 12A taken along lines 12B—12B of FIG. 12A.

In FIGS. 12A and 12B an alternate embodiment of the blade 34 of FIG. 5A is shown having a continuous bead 86 formed in the wide transverse faces of the blade 88. Continuous bead 86 is formed by providing a continuous series of staples placed end-to-end, by sewing or stitching with a thread or by cementing a bead to each wide transverse face of the blade.

A pair of staples 61, 63, are emplaced transversely of blade 34 at a location exteriorly of apertures 60, 62 in the blade. The purpose of these staples is to provide a means for supporting the extremities of the wiping blade. Such an embodiment is an alternate to forming the ends of the holder with the enlarged flattened areas at the ends of the holder defined by boundary line 15 is shown in FIGS. 1 and 2.

Still another alternate embodiment of a support for the ends of the blade is shown in FIGS. 7 and 8. In this embodiment a spring loaded clip 68 is attached to leg 72 of a holder 70 extending inwardly and downwardly along curved portion 84 of leg 72. Clip 68 acts in the same manner as the flattened areas of FIGS. 1 and 2 providing additional support for the blade and causing uniform pressure to be transmitted to the blade all along its length to its longitudinal extremities. In a preferred embodiment clip 68 is fabricated of thin (0.003–0.005 in.) spring brass having a leg 69 with a curved inner face, thereby effectively increasing the thickness of the curved portion 74 approximately 1/32 inch.

The holder of FIG. 7 is also provided with the wire spring support for the end of the blade. As shown a wire spring 73 is spot welded at 75 to the exterior of leg 72 of the holder. A pin 76 formed in the end of the wire spring extends into aperture 78 of the holder and another aperture (not shown) in the blade to provide support of the blade against end compression.

An alternate embodiment to the wire spring pin arrangement is shown in FIG. 9. As shown therein, a tang 80 is formed in the end of a holder 82, the tang having a short pin 84 raised from the inner face thereof. The tang is tensionably retractable to accommodate insertion of the blade in the holder. A blade such as blade 34 of FIG. 5 is contemplated for use with the embodiment of FIG. 9 having a staple 56 is shown in phantom in FIG. 5A placed adjacent the aperture in the blade. The staple 56 is likewise illustrated in FIG. 5C. Staple 56 reinforces the edge of the aperture 62 so that the edge cannot be compressed, collapsed, or rolled over when the end of the blade is bumped. A blade such as blade 34 of FIG. 5A is contemplated for use with the embodiment of the holder of FIG. 1 so that bumping the end of the blade does not cause spring pins 21, 23 to pop out of the aperture.

The step pin 54 used with holder embodiment 44 is shown in FIG. 10. As shown therein pin 54 comprises an enlarged central portion 55 of a diameter such that portion 55 fits snugly in apertures provided in the end of the wiping blades according to the present invention and reduced extremities 57, 58 of a length and diameter for seating within the apex of notches 64, 66 to secure the ends of blade within the holder and provide support against end compression.

What is claimed is:

1. An improved squeegee comprising:

a wiping blade holder of a generally U-shaped channel configuration having a wide upper leg and a narrower lower leg interconnected at one side thereof by a web portion, said legs being spaced apart so as to receive a flat wiping blade, said upper leg having longitudinally extending blade engaging means in the inside face thereof intermediate the longitudinal edges of the leg for slidably engaging mating holder engaging means on the blade to hold the wiping blade along a longitudinal axis so as to provide a wiping edge of the squeegee, said blade engaging means being dimensioned relative to the holder engaging means to provide a slight floating movement of the blade in the holder to precisely align the blade to a working position supported by direct face contact with the upper leg and contact with the web portion at the edge opposite the wiping edge;

an elongated resilient flat blade defining at least one sharp wiping edge along the longitudinal extent thereof; said blade having holder engaging means located on at least one wide face thereof for matingly engaging the blade engaging means of the holder along the longitudinal extent of the blade; and handle means attached to said holder.

2. A squeegee according to claim 1 wherein the blade engaging means on the upper leg of the holder is a bead raised from the surface of the inside face of said upper leg and the blade engaging means on the blade is a groove located along the center line of the wide face of the blade.

3. A squeegee according to claim 1 wherein the blade engaging means on the upper leg of the holder is a groove formed in the inner face of said upper leg and extending the length thereof and the blade engaging means on the blade is a protrusion formed in the wide face of the blade along the center line thereof.

4. A squeegee according to claim 3 wherein the protrusion formed in the blade is provided by means of staples driven into the blade located at spaced-apart intervals along the longitudinal axis of the blade.

5. A squeegee according to claim 1 including support means cooperating with the holder for providing additional suport for the wiping blade.

6. A squeegee according to claim 5 wherein said additional support means are formed in said upper leg of the holder as an integral part thereof.

7. A squeegee according to claim 5 wherein said additional support means are clips attached to the ends of the upper leg of the holder.

8. A squeegee according to claim 1 wherein the upper leg of the holder is curved outwardly away from the wiping blade in the direction of the longitudinal wiping edge of the squeegee.

9. A squeegee according to claim 8 wherein a section of the normally curved portion of the leg at the longitudinal ends of the holder is flattened to provide additional support for the wiping blade.

10. A squeegee according to claim 1 including second balde engaging means provided adjacent the ends of the holder for preventing compression of the wiping blade along its longitudinal axis.

11. A squeegee according to claim 10 wherein the wiping blade includes a pair of detents located adjacent the ends of the blade and the second blade engaging means on the holder are a pair of retaining means in registration with said detents, each of said retaining means being operatively related to an associated detent on the wiper blade.

12. A squeegee according to claim 11 wherein the retaining means are a pair of retractable pins for engaging the detents in the wiping blade.

13. A squeegee according to claim 12 wherein the pins are the extremities of a wire spring secured to the holder.

14. A squeegee according to claim 1 wherein the wiping blade includes a pair of apertures located adjacent the ends of the blade and the holder includes a longitudinal slot formed in the end of each leg of the holder, squeegee including step pins having a central body portion of a ciameter larger than its end portions, the diameter of the central portion corresponding to the diameter of the apertures in the blade, the diameter of the smaller end portions of the pins corresponding to the axial dimension at the base of the slots such that the end portions of said step pins fit within the seat in said slots to hold the wiping blade under tension in the holder.

15. A squeegee according to claim 1 wherein the wiping blade includes a pair of detents and the upper leg of the holder has a resilient tang formed therein, said tang being provided with a protrusion adjacent the free end thereof in registration with the detents in the wiping blade, said tangs engaging the detents when a blade is operatively mounted in the holder.

16. An improved squeegee wiping blade comprising:

a length of resilient material of a rectangular cross section along its transverse and longitudinal axis, the blade being formed by being cut from a reltatively thin, flat sheet of resilient material to provide a blade having two narrow elongated faces, two narrow end faces, and two relatively wide transverse faces, the transverse dimension of the blade, the junction of the elongated faces and the transverse faces providing four sharp wiping edges;

a pair of apertures extending through the blade perpendicular to its transverse faces, the apertures being dimensioned and located to register with blade retaining means, and a holder engaging protrusion in a transverse face and extending longitudinally thereof, said protrusion being dimensioned to retain the blade with a slightly floating restraint in a blade holder.

17. A wiping blade according to claim 16 wherein the holder engaging protrusion is a continuous bead formed in the transverse face of the blade.

18. A wiping blade according to claim 16 wherein the holder engaging protrusion is a plurality of staples driven through and located at spaced intervals along the central longitudinal axis of the transverse face of the blade.

19. A blade according to claim 18 including means located in the blade adjacent the ends thereof for providing additional support for the ends of the blade.

20. A blade according to claim 20 wherein said suporting means is a pair of staples positioned transversely of the longitudinal axis of the blade.

21. A blade according to claim 16 wherein the apertures are located adjacent each end of the blade, each of said apertures having reinforcing means at the side thereof adjacent the free end of the blade.

22. A blade according to claim 21 wherein the reinforcing means are a pair of staples, each positioned tranversely of the blade tangent to its associated aperture.

23. An improved squeegee wiping blade comprising:

a length of resilient material of a rectangular cross section along its transverse and longitudinal axis, the blade being formed by being cut from a relatively thin, flat sheet of resilient material to provide a blade having two narrow elongated faces, two narrow end faces, and two relatively wide transverse faces, the transverse dimension of the blade being large relative to the thickness dimension of the blade, the junction of the elongated faces and the transverse faces providing four sharp wiping edges;

a pair of apertures extending through the blade perpendicular to its transverse faces, the apertures being dimensioned and located to register with blade retaining means, and a holder engaging groove in the surface of the blade and extending along the longitudinal extent thereof, said groove being dimensioned to retain the blade with a slightly floating restraint in a blade holder.

24. A blade according to claim 23 wherein the apertures are located adjacent each end of the blade.

* * * * *

UNITED STATES PATENT AND TRADEMARK OFFICE

CERTIFICATE OF CORRECTION

PATENT NO. : 3,950,813

DATED : April 20, 1976

INVENTOR(S) : S. Keith Buck

It is certified that error appears in the above-identified patent and that said Letters Patent are hereby corrected as shown below:

In the drawings, Sheet 1, FIG. 1, the reference numeral "21" should be -- 29 --; reference numeral 33 and lead line should be deleted; the lead line from reference numeral 35 should be deleted and a new lead line inserted terminating at the same point as the now deleted lead line from reference numeral 33; Sheet 1, FIG. 2, delete the reference numeral 26 and lead line; Sheet 2, FIG. 8A, add reference numeral 69 and lead line terminating on upper side of clip shown in figure. Column 5, line 8 "anad" should read -- and --; column 6, line 26, "anad" should read -- and --; column 6, line 48, "apaertures" should read -- apertures --; column 8, line 66, "suport" should read -- support --; column 9, line 14 "balde" should read -- blade-- column 9, line 34, before "squeegee" the word --said -- should be inserted; column 9, line 35, "ciameter" should read -- diameter- column 9, line 40, delete "the" and insert -- and --; column 10, line 23, delete "20" and insert -- 19 --.

Signed and Sealed this

Second Day of November 1976

[SEAL]

*Attest:*

RUTH C. MASON
*Attesting Officer*

C. MARSHALL DANN
*Commissioner of Patents and Trademarks*